US008496726B2

(12) United States Patent
Yamaji et al.

(10) Patent No.: US 8,496,726 B2
(45) **Date of Patent: *Jul. 30, 2013**

(54) CLAYISH COMPOSITION FOR FORMING SINTERED SILVER ALLOY BODY, POWDER FOR CLAYISH COMPOSITION FOR FORMING SINTERED SILVER ALLOY BODY, METHOD FOR MANUFACTURING CLAYISH COMPOSITION FOR FORMING SINTERED SILVER ALLOY BODY, SINTERED SILVER ALLOY BODY, AND METHOD FOR MANUFACTURING SINTERED SILVER ALLOY BODY

(75) Inventors: Takashi Yamaji, Sanda (JP); Yasuo Ido, Kobe (JP); Shinji Otani, Kobe (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/608,179

(22) Filed: Sep. 10, 2012

(65) Prior Publication Data

US 2012/0325050 A1 Dec. 27, 2012

Related U.S. Application Data

(62) Division of application No. 12/929,488, filed on Jan. 28, 2011, now Pat. No. 8,308,841.

(30) Foreign Application Priority Data

Apr. 9, 2010 (JP) ..... 2010-090530
Jul. 27, 2010 (JP) ..... 2010-168119
Oct. 22, 2010 (JP) ..... 2010-237797

(51) Int. Cl.
*B22F 1/00* (2006.01)
*C22C 1/05* (2006.01)

(52) U.S. Cl.
USPC ..... 75/252; 75/255; 419/65

(58) Field of Classification Search
USPC ..... 106/1.13, 1.14, 1.18, 1.19; 204/291–293; 148/430–431; 75/228–250, 255, 252, 253, 75/254, 950, 951
See application file for complete search history.

(56) References Cited

U.S. PATENT DOCUMENTS 3,505,065 A 4/1970 Gwyn, Jr.
3,756,834 A 9/1973 Short (Continued)

FOREIGN PATENT DOCUMENTS

JP 52-050558 A 4/1977
JP 59-219428 A 12/1984

(Continued)

OTHER PUBLICATIONS

Office Action mailed Nov. 16, 2010, issued on Japanese Patent Application No. 2010237797 and English translation thereof.

(Continued)

*Primary Examiner* — Scott Kastler
*Assistant Examiner* — Vanessa Luk
(74) *Attorney, Agent, or Firm* — Edwards Wildman Palmer LLP

(57) ABSTRACT

A clayish composition for forming a sintered silver alloy body capable of forming a sintered silver alloy body, which is not easily discolored even in the atmosphere and has excellent tensile strength, flexural strength, surface hardness (hereinafter, sometimes collectively referred to as 'mechanical strength'), elongation or the like, powder for the clayish composition for forming a sintered silver alloy body, a method for manufacturing the clayish composition for forming a sintered silver alloy body, a sintered silver alloy body and a method for manufacturing the sintered silver alloy body.

8 Claims, 3 Drawing Sheets

U.S. PATENT DOCUMENTS

| | | | | |
|---|---|---|---|---|
| 4,565,590 | A | 1/1986 | Grosse et al. | |
| 4,963,187 | A | 10/1990 | Kondo et al. | |
| 8,308,841 | B2 * | 11/2012 | Yamaji et al. | 75/252 |

FOREIGN PATENT DOCUMENTS

| | | | |
|---|---|---|---|
| JP | 59-226136 | A | 12/1984 |
| JP | 59-226138 | A | 12/1984 |
| JP | 60-021302 | A | 2/1985 |
| JP | 60-029404 | A | 2/1985 |
| JP | 05-263103 | A | 10/1993 |
| JP | 3274960 | B2 | 9/1997 |
| JP | 10-287938 | A | 10/1998 |
| JP | 2000-026903 | A | 1/2000 |
| JP | 2002-220604 | A | 8/2002 |
| JP | 4265127 | B2 | 8/2002 |
| JP | 2002-356702 | A | 12/2002 |
| JP | 2004-292894 | A | 10/2004 |
| JP | 2006-183076 | A | 7/2006 |

OTHER PUBLICATIONS

Robert F. Conley, "Dispersing Metal Powders," Ch. 12.2, Practical Dispersion: A Guide to Understanding and Formulating Slurries, Wiley-VCH, 1996, pp. 340-358.

Ronald G. Iacocca, "Particle Size and Size Distribution in Metal Powders," ASM Handbooks Online, vol. 7, ASM International, 2002.

* cited by examiner

POST PROCESSING, SUCH AS SURFACE POLISHING, AND DECORATING TREATMENT

CLAYISH COMPOSITION FOR FORMING SINTERED SILVER ALLOY BODY, POWDER FOR CLAYISH COMPOSITION FOR FORMING SINTERED SILVER ALLOY BODY, METHOD FOR MANUFACTURING CLAYISH COMPOSITION FOR FORMING SINTERED SILVER ALLOY BODY, SINTERED SILVER ALLOY BODY, AND METHOD FOR MANUFACTURING SINTERED SILVER ALLOY BODY

This application is a divisional application of U.S. application Ser. No. 12/929,488 filed Jan. 28,2011.

TECHNICAL FIELD

The present invention relates to a clayish composition for forming a sintered silver alloy body, a powder for the clayish composition for forming a sintered silver alloy body, a method for manufacturing the clayish composition for forming a sintered silver alloy body, a sintered silver alloy body obtained from the clayish composition for forming a sintered body, and a method for manufacturing the sintered silver alloy body.

Priority is claimed on Japanese Patent Application No. 2010-090530, filed Apr. 9, 2010, Japanese Patent Application No. 2010-168119, filed Jul. 27, 2010, and Japanese Patent Application No. 2010-237797, filed Oct. 22, 2010, the content of which is incorporated herein by reference.

BACKGROUND ART

In the past, silver-made jewelry, artistically crafted items, and the like represented by, for example a ring or the like, have been manufactured by, in general, casting or forging a silver-containing material. However, in recent years, silver clay (clayish composition for forming a sintered body) including silver powder has become commercially available, and a method is suggested that manufactures silver jewelry or artistically crafted items having an arbitrary shape by making the silver clay into an arbitrary shape and then firing the silver clay (for example, refer to Patent Document 1). According to such a method, silver clay can be freely shaped like general clay is shaped, therefore silver-made jewelry, artistically crafted items and the like can be manufactured in an extremely simple manner by drying a shaped body obtained by shaping and then firing the shaped body using a furnace.

Meanwhile, the silver clay described in Patent Document 1 is, in general, obtained by adding a binder or water, and, as a necessity, a surface active agent or the like to the powder of pure silver (pure Ag) and then kneading the mixture. However, in a case in which silver clay is made using silver powder of pure Ag and then heated so as to manufacture a silver sintered body, there is a problem in that the obtained silver sintered body has poor strength characteristics since the strength of pure Ag itself is weak.

To solve the above-described problem of the strength characteristics, another method is also suggested that manufactures a silver sintered body, which is a so-called sterling silver, by shaping and then firing silver clay obtained by constituting a silver powder with a silver alloy including Ag in a component ratio of 92.5% and, furthermore, copper (Cu) or the like, and adding the silver powder to a binder or the like and kneading the mixture (for example, refer to the 'Example' section or the like in Patent Document 2).

Patent Document

[Patent Document 1] Japanese Patent Publication No. 4265127

[Patent Document 2] Japanese Patent Publication No. 3274960

DISCLOSURE OF INVENTION

Problems to be Solved by the Invention

However, even if silver clay made of sterling silver, which is an Ag—Cu alloy, has an improved strength characteristics compared with a silver sintered body using the silver powder of pure Ag as described in Patent Document 2, there is a problem in that the hue of the silver clay is liable to degrade since Cu included in the silver clay may be easily altered. Specifically, in a case in which the silver clay made of sterling silver is kept at room temperature in the atmosphere, it is observed that the silver clay may already be discolored at a point in time several days after the manufacturing date of the silver clay, and not only the surface but also the inside is discolored.

The present invention has been made in consideration of the above problem, and the object of the present invention is to provide a clayish composition for forming a sintered silver alloy body capable of forming a sintered silver alloy body which is not easily discolored even in the atmosphere and has excellent tensile strength, flexural strength, surface hardness (hereinafter, sometimes, collectively referred to as 'mechanical strength'), elongation or the like, powder for the clayish composition for forming a sintered silver alloy body, a method for manufacturing the clayish composition for forming a sintered silver alloy body, a sintered silver alloy body and a method for manufacturing the sintered silver alloy body.

Means for Solving the Problem

The inventors of the present invention have conducted thorough studies in order to solve the above problem and found that the discoloration of silver clay (clayish composition for forming a sintered silver alloy body) can be suppressed by constituting powder for silver clay (powder for the clayish composition for forming a sintered silver alloy body), which constitutes silver clay (clayish composition for forming a sintered silver alloy body), with powder including silver powder and copper oxide powder.

The present invention has been made based on the above founding and includes the constitution shown below.

(1) The clayish composition for forming a sintered silver alloy body according to the present invention is characterized by including a powder constituent including silver powder and copper oxide powder, a binder and water.

The clayish composition for forming the sintered silver alloy body with such a constitution includes the silver powder, the copper oxide powder, the binder and water. Here, the copper oxide is chemically stable compared with metallic copper, thereby having a less possibility of being easily altered (change in the valence of copper ions) in the atmosphere. Therefore, the discoloration of the clayish composition for forming a sintered silver alloy body can be suppressed.

Furthermore, since the binder in the clayish composition for forming a sintered silver alloy body can be combusted and thus removed by using oxygen in the copper oxide, it is possible to accelerate sintering.

(2) Here, the clayish composition for forming the sintered silver alloy body according to (1) preferably includes at least copper (II) oxide powder (CuO powder) as the copper oxide powder.

Since the clayish composition for forming the sintered silver alloy body with this constitution includes the copper (II) oxide powder, which is chemically stable, the discoloration of the clayish composition for forming the sintered silver alloy body can be reliably prevented.

In addition, the binder in the clayish composition for forming the sintered silver alloy body can be combusted and thus removed by using the oxygen in CuO. Therefore, even in a relatively thick object with a thickness of 5 mm or more, the binder can be combusted inside the object by using the oxygen of CuO, it is therefore possible to manufacture a high-quality sintered silver alloy body.

(3) In addition, in the clayish composition for forming the sintered silver alloy body according to (1) or (2), the powder constituent preferably includes CuO powder as the copper oxide powder in a range of from 4 mass % to 35 mass % with respect to the entire powder constituent, and the amount of Ag element is preferably from 46 mass % to 97 mass % with respect to the entire metal elements in the powder constituent.

If the amount of CuO powder is less than 4 mass %, the mechanical strength may not be sufficiently improved. On the other hand, if the amount of CuO powder exceeds 35 mass %, the elongation degrades and a sintered silver alloy body made by using the powder for silver clay may not exhibit a beautiful silver color even after polishing. Consequently, the amount of CuO powder is preferably in a range of from 4 mass % to 35 mass %.

(4) Furthermore, in the clayish composition for forming the sintered silver alloy body according to any one of (1) to (3), the powder constituent preferably includes CuO powder as the copper oxide powder in a range of from 12 mass % to 35 mass % with respect to the entire powder constituent, and the amount of Ag element is preferably from 46 mass % to 90 mass % with respect to the entire metal elements in the powder constituent.

In the case of the amount of CuO powder of 12 mass % or more, the binder included in the clayish composition for forming the sintered silver alloy body can be combusted and thus removed by using the oxygen of CuO. Therefore, pre-firing is not necessary to remove the binder in advance, and it is possible to conduct a drying treatment after making and then conduct firing.

(5) In addition, in the clayish composition for forming the sintered silver alloy body according to any one of (1) to (4), the powder constituent further includes metallic copper, and the amount of the metallic copper in the powder constituent is preferably 2 mass or less with respect to the entire powder constituent.

By containing 2 mass % or less of the metallic copper in the powder constituent with respect to the entire powder constituent, the discoloration of the clayish composition for forming the sintered silver alloy body can be reliably prevented. Here, examples of the metallic copper included in the powder constituent can include metallic copper powder, and metallic copper included in the alloy powder of Ag and Cu.

(6) Furthermore, in the clayish composition for forming the sintered silver alloy body according to any one of (1) to (5), the copper oxide powder further includes copper (I) oxide ($Cu_2O$), the total amount of copper (II) oxide and copper (I) oxide in the powder constituent is preferably 54 mass % or less with respect to the entire powder constituent.

If the powder constituent includes a large amount of oxides, such as CuO or $Cu_2O$, removal of the binder and reduction by CO become difficult, therefore there is a concern of adversely affecting the sintering property when firing the clayish composition for forming the sintered silver alloy body. In addition, $Cu_2O$ is also gradually changed to CuO, but discoloration is not as abrupt as when the metallic copper is added. From the above facts, in a case in which the powder constituent includes copper (I) oxide, the total amount of copper (II) oxide and copper (I) oxide in the powder constituent is preferably 54 mass % or less with respect to the entire powder constituent.

(7) In addition, in the clayish composition for forming the sintered silver alloy body according to any one of (1) to (6), the average particle diameter of the copper oxide powder is preferably 1 μm or more and 25 μm or less.

In this case, the mechanical strength, elongation or the like of the sintered silver alloy body obtained by firing the clayish composition for forming a sintered silver alloy body can be improved.

(8) Furthermore, at least one of fatty substance and surface active agent, according to necessity, may be added to the clayish composition for forming the sintered silver alloy body according to any one of (1) to (7).

(9) In addition, in the clayish composition for forming a the sintered silver alloy body according to any one of (1) to (8), the binder may include at least one kind or two or more kinds of binders selected from the group consisting of a cellulose-based binder, a polyvinyl compound-based binder, an acrylic compound-based binder, a wax-based binder, a resin-based binder, starch, gelatin and flour. In addition, among the above, the binder most preferably includes a cellulose-binder, particularly, a water-soluble cellulose.

The kind of the surface active agent is not particularly limited, and a general surface active agent may be used.

Examples of the fatty substance can include an organic acid (oleic acid, stearic acid, phthalic acid, palmitic acid, sebacic acid, acetyl citrate, hydroxybenzoic acid, lauric acid, myristic acid, caproic acid, enanthic acid, butyric acid and capric acid), organic acid ester (organic acid ester including a methyl group, an ethyl group, a propyl group, a butyl group, an octyl group, a hexyl group, a dimethyl group, a diethyl group, an isopropyl group or an isobutyl group), higher alcohols (octanol, nonanol, decanol), polyhydric alcohols (glycerin, arabinitol, sorbitan), or ether (dioctyl ether, didecyl ether).

(10) The present powder used for the clayish composition for forming the sintered silver alloy body according to any one of (1) to (9) is characterized by including the silver powder and the copper oxide powder.

(11) In addition, the powder for the clayish composition for forming the sintered silver alloy body according to (10) preferably includes copper (II) oxide powder (CuO powder) as the copper oxide powder.

(12) Furthermore, the powder for the clayish composition for forming the sintered silver alloy body according to (10) or (11) preferably includes the CuO powder as the copper oxide powder in a range of from 4 mass % to 35 mass % with respect to the entire powder for the clayish composition, and the amount of Ag element is preferably from 46 mass % to 97 mass % with respect to the total metal component, which does not include the oxygen in the powder for the clayish composition.

(13) In addition, the powder for the clayish composition for forming the silver alloy body according to any one of (10) to (12) preferably includes CuO powder as the copper oxide powder in a range of from 12 mass % to 35 mass % with respect to the entire powder for the clayish composition, and the amount of Ag element is preferably from 46 mass % to 90 mass % with respect to the total metal component, which does not include the oxygen in the powder for the clayish composition.

(14) Furthermore, the powder for the clayish composition for forming the sintered silver alloy body according to any one of (10) to (13) preferably includes metallic copper, and an amount of the metallic copper in the powder for the clayish composition is preferably 2 mass % or less with respect to the entire powder for the clayish composition.

(15) In addition, the powder for the clayish composition for forming the sintered silver alloy body according to any one of (10) to (14) preferably further includes copper (I) oxide, and the total amount of copper (II) oxide and copper (I) oxide in the powder for the clayish composition is preferably 54 mass % or less with respect to the entire powder for the clayish composition.

(16) Furthermore, in the powder for the clayish composition for forming the sintered silver alloy body according to any one of (10) to (15), the average particle diameter of the copper oxide powder is preferably 1 μm or more and 25 μm or less.

According to the powder for the clayish composition for forming the sintered silver alloy body with the above constitution, the above-described clayish composition for forming the sintered silver alloy body can be constituted, therefore the discoloration of the clayish composition for forming the sintered silver alloy body can be reliably prevented.

(17) The method for manufacturing the clayish composition for forming a sintered silver alloy body according to the present invention is characterized by mixing the powder for the clayish composition for forming the sintered silver alloy body according to any one of (10) to (16), and binding agent including a binder and water.

According to the method for manufacturing the clayish composition for forming a sintered silver alloy body with such a constitution, it is possible to manufacture a clayish composition for forming a sintered silver alloy body which includes the copper oxide powder and is difficult to be discolored.

(18) The sintered silver alloy body according to the present invention is characterized by being obtained by firing the clayish composition for forming a sintered body according to any one of (1) to (9).

According to the sintered silver alloy body with such a constitution, since the sintered silver alloy body is a body obtained by firing a clayish composition for forming a sintered silver alloy body with the above-described constitution, compared with a body obtained by firing silver clay made of pure Ag powder, the mechanical strength can be improved. That is, a sintered silver alloy body obtained by heating and firing the above clayish composition for forming a sintered silver alloy body has excellent mechanical strength, elongation, and the like.

(19) The method for manufacturing the sintered silver alloy body according to the present invention is characterized by obtaining a sintered silver alloy body by making the clayish composition for forming a sintered silver alloy body according to any one of (1) to (9) into an arbitrary shape so as to produce an object, and by firing in a reduction atmosphere or a non-oxidizing atmosphere after drying the object.

According to the method for manufacturing the sintered silver alloy body with the above constitution, it is possible to manufacture a sintered silver alloy body with excellent mechanical strength, elongation, and the like by making the above clayish composition for forming a sintered silver alloy body and then conducting a drying treatment and a heating and firing treatment.

Here, as described in the above, in a case in which the clayish composition for forming a sintered silver alloy body includes CuO powder at an amount of 12 mass % or more with respect to the entire powder constituent, the binder included in the clayish composition for forming a sintered silver alloy body can be combusted and thus removed by using the oxygen in CuO, therefore a pre-baking process for removing the binder can be omitted.

(20) The method for manufacturing the sintered silver alloy body according to (19) preferably includes manufacturing a sintered silver alloy body by firing the object in a reduction atmosphere or a non-oxidizing atmosphere at a firing temperature of from 650° C. to 830° C. for a time of from 15 minutes to 120 minutes after drying the object.

According to the method for manufacturing the sintered silver alloy body with such a constitution, it is possible to reliably conduct sintering to burn off and thus remove the binder by limiting the firing conditions of the object of the clayish composition for forming a sintered silver alloy body to the above.

(21) Furthermore, in the method for manufacturing the sintered silver alloy body according to (19) or (20), the object has portions with a thickness of 5 mm or more, therefore the rate of rising temperature from room temperature to the above firing temperature is preferably in a range of from 15° C./min to 80° C./min when firing the object in a reduction atmosphere or a non-oxidizing atmosphere after drying the object.

In general, for a relatively thick object of the clayish composition for forming a sintered silver alloy body with a thickness of 5 mm or more, it is extremely difficult to combust and remove the binder inside the object, therefore it is necessary to decrease the rate of rising temperature to the firing temperature. This is because oxygen to combust the binder is supplied from the surface layer of the object; therefore the binder is not sufficiently combusted inside the object.

Here, a thickness of 5 mm or more means that the diameter of at least one inscribed sphere present inside the object is 5 mm or more.

Here, since the method for manufacturing the sintered silver alloy body according to the present invention uses the clayish composition for forming a sintered silver alloy body including copper oxide powder as described above, the binder inside the object can be reliably combusted by using oxygen in the copper oxide powder. Therefore, even when a relatively thick object of the clayish composition for forming a sintered silver alloy body with a thickness of 5 mm or more is fired at a relatively fast rate of temperature rise from room temperature to the firing temperature set in a range of from 15° C./min to 80° C./min, it is possible to manufacture a sintered silver alloy body that is sintered far enough into the inside.

Therefore, a sintered silver alloy body can be efficiently manufactured.

Particularly, in the case of including copper (II) oxide (CuO) as the copper oxide powder, since the content of oxygen is relatively high, sintering can be accelerated, and a relatively thick object of the clayish composition for forming a sintered silver alloy body with a thickness of 5 mm or more can be reliably sintered.

(22) In addition, the method for manufacturing the sintered silver alloy body according to any one of (19) to (21) preferably includes firing in a state in which the object is buried in activated carbon.

According to the method for manufacturing the sintered silver alloy body with such a constitution, the sintering of the object can be accelerated by the reduction of the activated carbon.

EFFECTS OF THE INVENTION

According to the clayish composition for forming a sintered silver alloy body according to the present invention, with the above constitution and effects, it is possible to suppress the discoloration of the clayish composition for forming a sintered silver alloy body and to improve the mechanical strength, elongation, and the like of a sintered silver alloy body obtained by heating and firing the clayish composition after making.

According to the powder for the clayish composition for forming a sintered silver alloy body according to the present invention, it is possible to suppress the discoloration of a clayish composition for forming a sintered silver alloy body by constituting a clayish composition for forming a sintered silver alloy body using the powder for the clayish composition for forming a sintered silver alloy body.

According to the method for manufacturing the clayish composition for forming a sintered silver alloy body according to the present invention, it is possible to reliably manufacture the above clayish composition for forming a sintered silver alloy body.

According to the sintered silver alloy body according to the present invention, it is possible to improve the mechanical strength of the silver sintered body compared with a body obtained by firing silver clay made of pure Ag powder.

In addition, according to the method for manufacturing the sintered silver alloy body according to the present invention, it is possible to manufacture a sintered silver alloy body with excellent mechanical strength, elongation, and the like by conducting a drying treatment or firing under the predetermined conditions after making the object by using a clayish composition for forming a sintered silver alloy body with the above constitution.

BEST MODE FOR CARRYING OUT THE INVENTION

Figure 1:
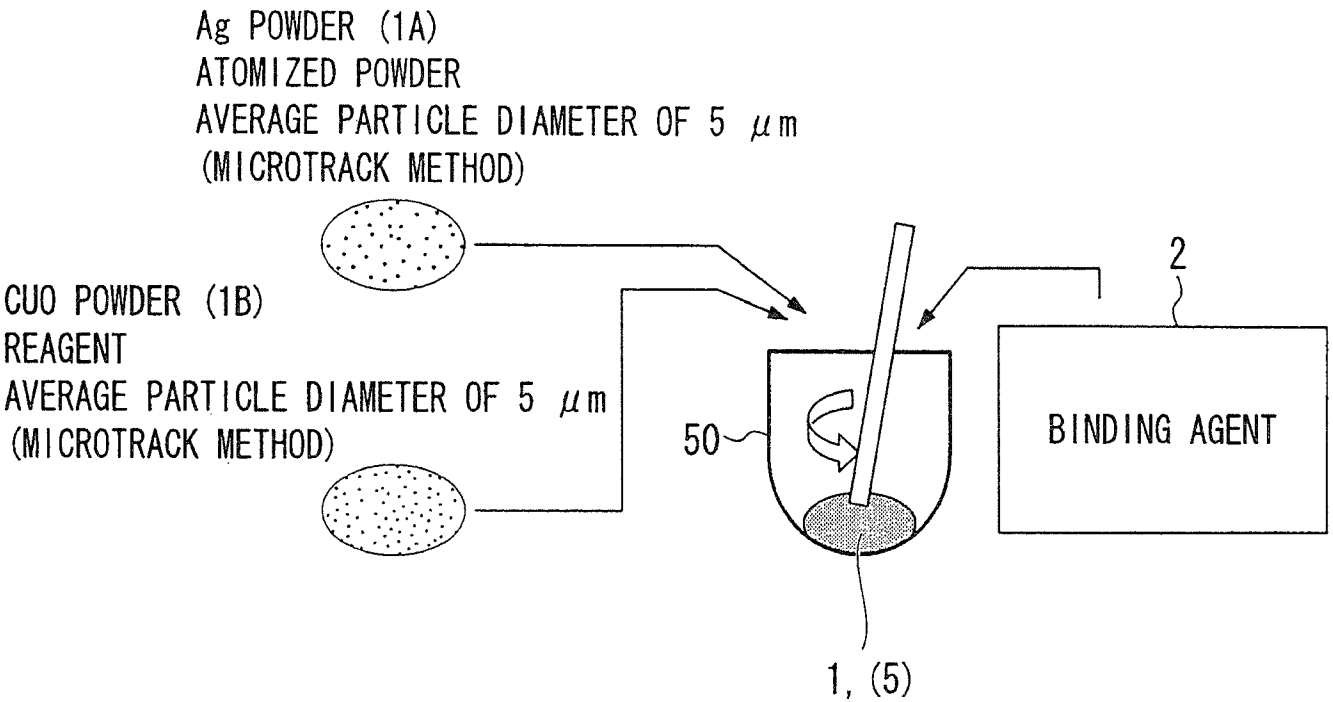
FIG. 1 is a view schematically showing a method for manufacturing the clayish composition for forming a sintered silver alloy body according to an embodiment of the present invention.

Hereinafter, an embodiment of the clayish composition for forming a sintered silver alloy body, a powder for the clayish composition for forming a sintered silver alloy body, a method for manufacturing the clayish composition for forming a sintered silver alloy body, a sintered silver alloy body and a method for manufacturing the sintered silver alloy body according to the present invention will be described with appropriate reference to the accompanying drawings.

Meanwhile, in the present embodiment, the clayish composition for forming a sintered silver alloy body and the powder for the clayish composition for forming a sintered silver alloy body will be described with names of 'silver clay' and 'powder for silver clay', respectively. Furthermore, a sintered silver alloy body will be described with names of "sintered body" or "silver sintered body".

(Powder for Silver Clay)

The powder for silver clay according to the present embodiment includes a silver-containing metal powder including silver (silver powder) and a copper-containing oxide powder including copper (copper oxide powder).

By using such a powder for silver clay, adding the below-described additives, and kneading the mixture so as to constitute silver clay, for a silver sintered body obtained by heating and firing, it is possible to obtain effects that improve the mechanical strength, elongation, and the like of the silver sintered body and to suppress the discoloration of the silver clay.

The powder for silver clay according to the present embodiment preferably uses CuO powder as the copper-containing oxide powder. In addition, Ag powder, Ag—Cu alloy powder or the like may be applied as the silver-containing metal powder.

Additionally, it is preferable to include CuO powder in a range of from 4 mass % to 35 mass % with respect to the entire powder constituent for silver clay, and the amount of Ag element is preferably from 46 mass % to 97 mass % with respect to the entire metal elements in the powder constituent.

Furthermore, it is preferable to include CuO powder in a range of from 12 mass % to 35 mass % with respect to the entire powder constituent for silver clay, and the amount of Ag element is preferably from 46 mass % to 90 mass % with respect to the entire metal elements in the powder constituent.

Here, Cu is an element having an effect of strength improvement by diffusing into Ag in the silver sintered body during sintering. In a case in which the amount of CuO powder is from 4 mass % to 35 mass %, the converted amount of Cu in the silver sintered body is from 3 mass % to 30 mass %. If the amount of Cu in the silver sintered body is less than 3 mass %, there is a concern that it becomes difficult to obtain an effect of improving the mechanical strength of a silver sintered body obtained by firing the silver clay. In addition, if the amount of Cu exceeds 30 mass %, there is a concern that the elongation degrades. Therefore, it is preferable to set the amount of CuO powder in the powder for silver clay in a range of from 4 mass % to 35 mass % so as to include Cu in the silver sintered body at a amount of from 3 mass % to 30 mass %. Meanwhile, the amount of CuO powder is preferably 35 mass % or less in consideration of the hue of the silver sintered body obtained by firing the silver clay.

That is, to make the amount of Cu included in the silver sintered body in the above range, it is preferable to constitute the silver clay by adjusting the mixture ratio of the silver-containing metal powder to the copper-containing oxide powder in consideration of the components of the silver-containing metal powder including silver and the components of the copper-containing oxide powder.

Meanwhile, in the present embodiment, CuO powder was used as the copper-containing oxide powder, and Ag powder was used as the silver-containing metal powder. In addition, powder for silver clay was made to include CuO powder in a range of from 4 mass % to 35 mass % with respect to the entire powder for silver clay, and have Ag and unavoidable impurities as the remainder.

Hereinafter, the particle diameter of Ag powder and CuO powder included in the powder for silver clay according to the present embodiment will be described.

In the present embodiment, the particle diameter of Ag powder and CuO powder is not particularly limited, but considering a variety of characteristics, such as formability and the like, in the case of manufacturing silver clay by adding a binding agent as an additive and kneading, the particle diameter in the range shown below is preferable.

The average particle diameter of the Ag powder is preferably 25 μm or less. With the average particle diameter of the Ag powder in the above range, the hue of a silver sintered body obtained by firing the silver clay becomes good, and, in addition, the above effect of improving the mechanical strength, elongation, and the like of a silver sintered body can be stably obtained.

If the average particle diameter of the Ag powder exceeds 25 μm, there are concerns in that the hue of the silver sintered body degrades, and the effect of improving the mechanical strength decreases. In addition, if the average particle diameter of the Ag powder exceeds 25 μm, the firing property of the powder degrades, therefore a long firing time is required, and also there is a possibility of an adverse effect on the workability of the silver sintered body, which is not preferable.

Meanwhile, the lower limit of the average particle diameter is not particularly limited, but if the average particle diameter of the Ag powder is 1 μm or less, there is a concern in that the costs become higher in an industrial sense, and the limitation of an apparatus also needs to be considered; therefore it is preferable to consider 1 μm as the lower limit.

In addition, the average particle diameter of the Ag powder is more preferably in a range of from 1 μm to 20 μm, and still more preferably in a range of from 3 μm to 10 μm.

The average particle diameter of the CuO powder is preferably 25 μm or less. With the average particle diameter of the CuO powder in the above range, the above effect of improving the mechanical strength, elongation, and the like of a silver sintered body can be stably obtained.

If the average particle diameter of the CuO powder exceeds 25 μm, there is a concern in that it becomes difficult to obtain an effect of improving the mechanical strength of a silver sintered body. In addition, if the average particle diameter of the CuO powder exceeds 25 μm, similarly to the above case of the Ag powder, the firing property of the powder degrades, therefore a long firing time is required, and also there is a possibility of an adverse effect on the workability of the silver sintered body, which is not preferable.

Meanwhile, like the above Ag powder, the lower limit of the average particle diameter is not particularly established, but from the viewpoints of the limitation of an apparatus or industrial costs, it is preferable to consider 1 μm as the lower limit of the average particle diameter of the CuO powder.

In addition, the average particle diameter of the CuO powder is more preferably in a range of from 1 μm to 20 μm, and still more preferably in a range of from 3 μm to 10 μm.

Furthermore, in the present embodiment, since the sintering property is increased when firing an object of the silver clay by limiting the average particle diameters of the Ag powder and the CuO powder, which constitute the powder for silver clay, to such a predetermined particle diameter or less as described above, it is possible to make the treatment temperature in the below-described firing a low temperature.

Meanwhile, as a method to measure the average particle diameter of the above powder, for example, a well-known microtrack method can be used. In addition, in the present embodiment, d50 (median diameter) was considered to be the average particle diameter.

(Silver Clay)

Next, the silver clay of the present embodiment will be described.

The silver clay according to the present embodiment includes the powder for silver clay with the above constitution, a binder (an organic binder in the present embodiment) and water.

For example, the silver clay according to the present embodiment includes the powder for silver clay with the above constitution in a range of from 70 mass % to 95 mass %, and, furthermore, a binding agent including an organic binder and water in a range of from 5 mass % to 30 mass %. Here, other than the organic binder and water, a surface active agent or fatty substance may be added to the binding agent according to necessity.

Since the silver clay include the powder constituent including chemically stable CuO powder and Ag powder, the discoloration in the atmosphere is suppressed.

The organic binder used for the silver clay according to the present embodiment is not particularly limited, but an organic substance capable of making a clayish composition by binding the powder for silver clay can be used. Preferable examples of the organic substance include an organic substance constituted with at least one kind or two or more kinds of binders selected from the group consisting of a cellulose-based binder, a polyvinyl compound-based binder, an acrylic compound-based binder, a wax-based binder, a resin-based binder, starch, gelatin and flour. In addition, among the above, the binder most preferably includes a cellulose-binder, particularly, water-soluble cellulose.

The surface active agent is not particularly limited, and a general surface active agent (for example, polyethylene glycol or the like) may be used.

In addition, the kind of the fatty substance is not particularly limited, but examples thereof can include an organic acid (oleic acid, stearic acid, phthalic acid, palmitic acid, sebacic acid, acetyl citrate, hydroxybenzoic acid, lauric acid, myristic acid, caproic acid, enanthic acid, butyric acid and capric acid), organic acid ester (organic acid ester including a methyl group, an ethyl group, a propyl group, a butyl group, an octyl group, a hexyl group, a dimethyl group, a diethyl group, an isopropyl group or an isobutyl group), higher alcohols (octanol, nonanol, decanol), polyhydric alcohols (glycerin, arabinitol, sorbitan), and ether (dioctyl ether, dedecyl ether).

Hereinafter, an example of a method for manufacturing the silver clay according to the present embodiment will be described with reference to the schematic view shown in FIG. 1.

The method for manufacturing the silver clay 5 according to the present embodiment is a method that kneads the powder for silver clay 1 in a range of from 70 mass % to 95 mass %, and a binding agent 2 including the organic binder and water in a range of from 5 mass % to 30 mass %.

As shown in FIG. 1, in the method for manufacturing the silver clay 5 described in the present embodiment, firstly, each of Ag powder 1A and CuO powder 1B is fed into an mixing apparatus 50 in a predetermined amount. At this time, for example, 87.8 mass % of Ag powder 1A (average particle diameter of 5 μm: a microtrack method; atomized powder) and 12.2 mass % of CuO powder 1B (average particle diameter of 5 μm: a microtrack method; a reagent manufactured by Kishida Chemical Co., Ltd. with a purity of 97% or more) are fed.

Additionally, a powder for silver clay 1 is obtained by mixing each of the above material powder in the mixing apparatus 50.

Next, as shown in FIG. 1, a binding agent 2 is added to the powder for silver clay 1 in the mixing apparatus 50. At this time, the amount of the binding agent 2 added can be made approximately {total weight of the powder for silver clay 1 to binding agent 2=9:1}.

Here, the binding agent 2 includes the organic binder, the fatty substance and the surface active agent in a ratio of from 11 mass % to 17 mass %: 5 mass % or less: 2 mass % or less with water as the remainder.

Additionally, silver clay 5 is obtained by mixing and kneading the powder for silver clay 1 and the binding agent 2 in the mixing apparatus 50.

(Silver Sintered Body)

The silver sintered body according to the present embodiment is obtained by shaping and making an object by using the silver clay 5 with the above constitution into an arbitrary shape, and then firing it under the below-described conditions.

The silver sintered body has excellent mechanical strength, therefore, for example, even in the case of exerting a large external force, it is possible to suppress the occurrence of cracking or rupturing. In addition, since the silver sintered body according to the present embodiment has an excellent mechanical strength and a high elongation, for example, even in the case of conducting an additional process accompanying bending on the silver sintered body after firing, it is possible to suppress the occurrence of cracking or rupturing.

Hereinafter, an example of a method for manufacturing the silver sintered body according to the present embodiment will be described with reference to the schematic views of FIGS. 2A to 2D.

The method for manufacturing the silver sintered body 10 according to the present embodiment is a method that makes an object 51 by using the silver clay 5 with the above constitution into an arbitrary shape, then dries the object 51, for example at a temperature of from room temperature to 150° C. for from 30 minutes to 24 hours, and then fires the object 51 in a reduction atmosphere or a non-oxidizing atmosphere at a temperature of from 650° C. to 830° C. for 15 minutes to 120 minutes, thereby manufacturing a silver sintered body 10. Here, as a method that conducts the above firing, for example, a method that buries the dried object 51 in activated carbon and then conducts firing at a temperature of from 650° C. to 830° C. for 15 minutes to 120 minutes can be employed.

Figure 2A:
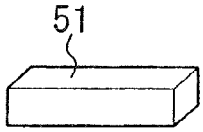
FIG. 2A is a view schematically showing a making process which makes an object by using the clayish composition in a method for manufacturing the sintered silver alloy body according to an embodiment of the present invention.

Firstly, as shown in FIG. 2A, the silver clay 5 is shaped and made into an arbitrary shape by, for example, mechanical working with a stamper, press molding, extrusion molding, or the like, or manual working by a worker, thereby making an object 51.

Figure 2B:
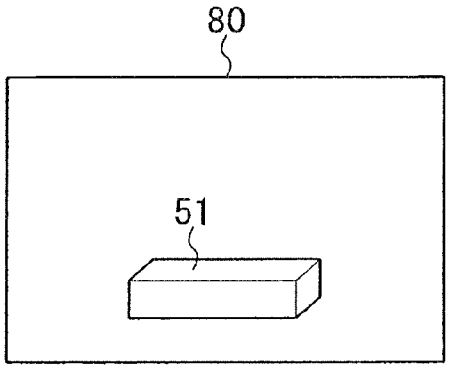
FIG. 2B is a view schematically showing a drying process which dries the object in an electric furnace in a method for manufacturing the sintered silver alloy body according to an embodiment of the present invention.

Next, as shown in FIG. 2B, the object 51 is fed into an electric furnace 80, and a drying treatment is conducted, thereby removing moisture or the like.

The drying temperature at this time is, from the viewpoints of an effective drying treatment, preferably, for example, in a range of from room temperature to 150° C. or from about 80° C. to 150° C. In addition, from the same viewpoints, the time of the drying treatment is, for example, from 30 minutes to 720 minutes, and more preferably from 30 minutes to 90 minutes, and, as an example, it is possible to conduct the drying treatment under the conditions of a drying temperature of about 100° C. and a drying time of about 60 minutes.

Figure 2C:
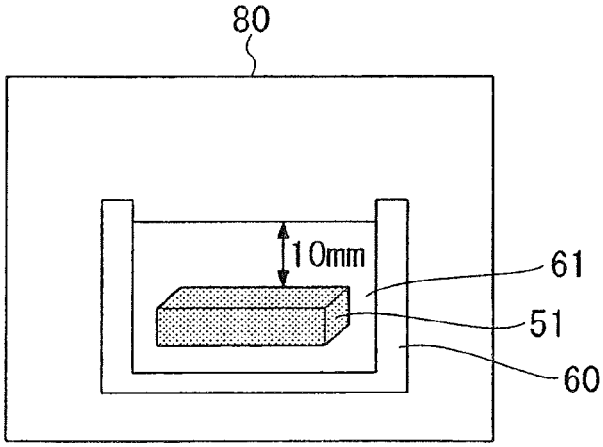
FIG. 2C is a view schematically showing a firing process which fires the object in the electric furnace in a method for manufacturing the sintered silver alloy body according to an embodiment of the present invention.

Subsequently, as shown in FIG. 2C, the object 51 is fired so as to produce a silver sintered body 10. At this time, by using the oxygen in CuO included in the powder for silver clay, the organic binder included in the silver clay is combusted, which makes it possible to remove the organic binder.

Here, the expression "using the oxygen in CuO" refers to a phenomenon in which CuO emits oxygen by thermal decomposition during firing and the oxygen helps the combustion of the organic binder.

In addition, in the present embodiment, a method is employed that manufactures a silver sintered body 10 by conducting firing on the object 51 using an apparatus shown in the drawing.

At this time, firstly, the object 51 is buried in the powdery or granular activated carbon 61 charged into a ceramic firing container 60. At this time, it is preferable to ensure a distance from the surface of the activated carbon 61 in the firing container 60 to the object 51 is10 mm or more in order to fully bury the object 51 and prevent the object 51 from being externally exposed in a case in which the activated carbon is combust.

Additionally, the firing container 60, in which the object 51 is buried in the activated carbon 61, is fed into the electric furnace 80, and heated at a temperature of from 650° C. to 830° C. as described above for 15 minutes to 120 minutes so as to conduct firing.

Because of a reduction atmosphere derived the activated carbon 61, the firing of the object 51 can be performed, even if the object 51 is not buried in the activated carbon 61.

Figure 2D:
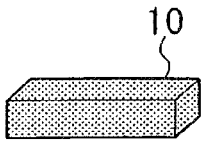
FIG. 2D is a view schematically showing a conducting post processing on the silver sintered body obtained by the firing in a method for manufacturing the sintered silver alloy body according to an embodiment of the present invention.

In addition, as shown in FIG. 2D, it is possible to produce a product by conducting post processing, such as surface polishing, decorating treatment, or the like, according to necessity, on the silver sintered body 10 obtained by firing.

Meanwhile, although the object 51 obtained by using the silver clay 5 and the silver sintered body 10 are shaped into a rough block shape for the convenience of illustration in the drawings and explanation in the example shown in FIGS. 2A to 2D, it is needless to say that it is possible to shape the silver clay 5 and the silver sintered body 10 into a variety of artistic shapes.

In addition, the present embodiment describes an example using an electric furnace in each process of the drying treatment and firing, but the present invention is not limited thereto, and can employ any apparatuses, such as a gas heating apparatus or the like, with no limitation as long as they can maintain the heating conditions.

As described in the above, according to the powder for silver clay 1, which is the present embodiment, it is possible to improve the mechanical strength, elongation, or the like of the silver sintered body 10 obtained by conducting a drying treatment after making an object and then heating and firing by constituting the silver clay 5 using the powder for silver clay 1 from the above constitution and effect. Furthermore, since the silver clay 5 includes chemically stable CuO, CuO is not easily altered in the atmosphere, and the discoloration of the silver clay 5 can be suppressed.

In addition, according to the silver clay 5, which is the present embodiment, since the silver clay 5 is obtained by using and kneading the powder for silver clay 1 with the above constitution, it is possible to improve the mechanical strength, elongation, or the like of the silver sintered body 10 obtained by making an object and then heating and firing in the same manner as the above. Furthermore, since Cu is included in the form of CuO, the discoloration of the silver clay 5 can be suppressed.

Moreover, according to the method for manufacturing the silver sintered body 10, which is the present embodiment, it is possible to manufacture a silver sintered body 10 with an excellent mechanical strength, elongation, or the like by making an object by using the silver clay 5 with the above constitution, and then conducting a drying treatment or firing under predetermined conditions.

Thus far, the embodiment of the present invention has been described, but the present invention is not limited thereto, and appropriate modifications can be made as long as they do not depart from the technical idea of the present invention.

For example, the embodiment described the powder for silver clay made of Ag powder and CuO powder, but the powder for silver clay is not limited thereto, and may be powder for silver clay including Ag—Cu alloy powder or the like, and copper-containing oxide powder. Alternatively, the powder for silver clay may include Cu powder or Ag—Cu alloy powder added in addition to Ag powder and copper-containing oxide powder. In this case, the metallic copper content included in Cu powder and Ag—Cu allow powder is preferably 2 mass % or less with respect to the entire powder constituent for silver clay. Thereby, the discoloration of the silver clay can be reliably suppressed. The metallic copper content in the powder for silver clay may be in a range of from 0.01 mass % to 2 mass %.

In addition, other than Ag powder and CuO powder, $Cu_2O$ powder may be used. In this case, the total amount of copper (II) oxide (CuO) and copper (I) oxide ($Cu_2O$) in the powder for silver clay is preferably 54 mass % or less with respect to the entire powder for silver clay. Thereby, it is possible to reliably accelerate sintering by using oxygen in a copper-containing oxide. The total amount of copper (II) oxide and copper (I) oxide in the powder for silver clay may be in a range of from 0.01 mass % to 54 mass %.

EXAMPLES

Example 1

Hereinafter, the clayish composition for forming a sintered body, powder for the clayish composition for forming a sintered body, method for manufacturing the clayish composition for forming a sintered body, silver sintered body and method for manufacturing the silver sintered body according to the present invention will be described in more detail by showing examples, but the present invention is not limited to the examples.

Examples of the Present Invention

Firstly, powder for the clayish composition for forming a sintered body (hereinafter, referred to as 'powder for silver clay') was manufactured in the following order. In the manufacturing of the powder for silver clay, Ag powder (average particle diameter of 5 μm: a microtrack method; atomized powder) and CuO powder (average particle diameter of 5 μm: a microtrack method; a reagent manufactured by Kishida Chemical Co., Ltd. with a purity of 97% or more) were mixed using a mixing apparatus as shown in FIG. 1 so as to obtain powder for silver clay including the remainder of Ag and CuO of 4 mass % (Example 1 of the present invention), the remainder of Ag and CuO of 9.2 mass % (Examples 2 and 9 of the present invention), the remainder of Ag and CuO of 12.2 mass % (Examples 3, 7 and 8 of the present invention), the remainder of Ag and CuO of 35 mass % (Example 4 of the present invention), the remainder of Ag and CuO of 3 mass % (Example 5 of the present invention) and the remainder of Ag and CuO of 40 mass % (Example 6 of the present invention).

In addition, as Examples 17 and 18 of the present invention, powder for silver clay was obtained by mixing copper-containing oxide powder manufactured by heating and oxidizing metallic copper powder (average particle diameter of 20 μm: a microtrack method; reduced powder manufactured by Fukuda Metal Foil & Powder Co., Ltd.) in the atmosphere at 340° C. for 3 hours and Ag powder (average particle diameter of 5 μm: a microtrack method; atomized powder). Meanwhile, the mixture ratio was 12.2 mass of the copper-containing oxide powder to the remainder of the Ag powder.

Figure 3:
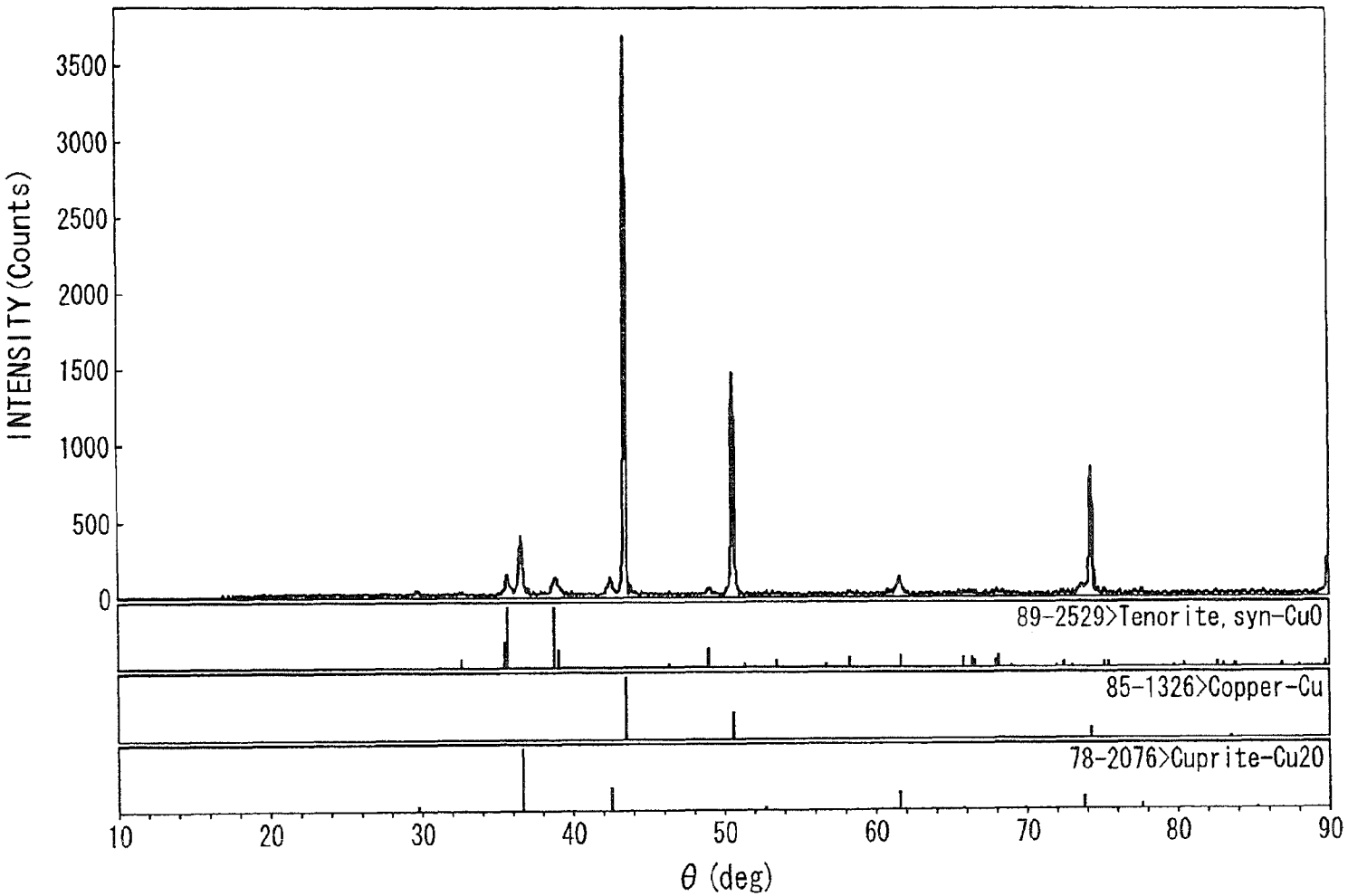
FIG. 3 is a view showing the results of an X-ray diffraction analysis on the copper-containing oxide powder obtained by oxidizing metallic copper powder.

Here, FIG. 3 shows the results of an X-ray diffraction analysis on the copper-containing oxide powder manufactured by oxidizing metallic copper powder using an X-ray diffraction apparatus RINT Ultima (trade name, manufactured by Rigaku Corporation). The results of the X-ray diffraction analysis clearly show the peaks of CuO and $Cu_2O$. In addition, the copper-containing oxide powder manufactured by oxidizing metallic copper powder appeared black across the entire surface. From this fact, it was observed that CuO was formed on at least the surface of the copper-containing oxide powder manufactured by oxidizing metallic copper powder.

Next, an organic binder, water, a surface active agent and a fatty substance were mixed so as to produce a binding agent. Then, the binding agent was added to the powder for silver clay obtained in the above order, which was left in the mixing apparatus, and kneaded so as to manufacture a clayish composition for forming a sintered body (hereinafter, referred to as 'silver clay').

Here, for the binding agents in Examples 1 to 7, 9, 17 and 18 of the present invention, 15 mass % of methyl cellulose, 3 mass % of olive oil, which is a kind of organic acid, and 1 mass % of polyethylene glycol were mixed as the organic binder, fatty substance and surface active agent, respectively, with water as the remainder.

In addition, 85 mass % of the powder for silver clay and 15 mass % of the binding agent were kneaded so as to produce the silver clay.

On the other hand, for the binding agent in Example 8 of the present invention, 13 mass % of a mixture of water-soluble cellulose ester (manufactured by Shin-Etsu Chemical Co., Ltd., METOLOSE SM8000) and potato starch (manufactured by Nippon Starch Chemical Co., Ltd., DELICA M9) mixed in a ratio of water-soluble cellulose ester to potato starch of 4 to 3 was mixed as the organic binder with the remainder of water.

In addition, 85 mass % of the powder for silver clay and 15 mass % of the binding agent were kneaded so as to produce the silver clay.

Here, an analysis on the amount of Cu included in the obtained silver clay was carried out. Firstly, the organic binder, surface active agent, and fatty substance were removed by washing the silver clay in hot water of 90° C. or more, and then a predetermined amount of specimen necessary for a quantitative analysis (about 10 g) was taken. Subsequently, a quantitative analysis of Cu was carried out on the specimen for analysis by an ICP analysis. As a result, as shown in Tables. 1 and 2, it was observed that the theoretical amount of Cu mixed as CuO powder and the actual amount of Cu included in the silver clay were matched.

Next, a wire-like object with the dimensions of a diameter of about 1.2 mm and a length of about 50 mm (before firing) and a prismatic object with the dimensions of a length of about 30 mm, a width of about 3 mm and a thickness of about 3 mm (before firing) were manufactured by using and using the silver clay obtained in the above order.

Subsequently, as shown in FIG. 2B, each object 51 of the wire-like object and the prismatic object was fed into an electric furnace (ORTON, manufactured by Evenheat Kiln Inc.) 80 for each example of the present invention at the same time, and dried under the conditions of a drying temperature of 100° C. and a drying time of 60 minutes, thereby removing moisture and the like included in the object 51.

Meanwhile, FIGS. 2A to 2C show only one prismatic object as the object 51 and do not show the wire-like object.

Here, for Examples 1, 2, 5, 7 and 18 of the present invention, a pre-baking process was carried out in the atmosphere at 500° C. for 30 minutes using the electric furnace 80 so as to remove the binder.

Meanwhile, in Examples 3, 4, 6, 8, 9 and 17 of the present invention, the pre-baking process was not carried out.

Next, the object 51 for each example of the present invention was subjected to firing at the same time so as to manufacture a silver sintered body.

Specifically, as shown in FIG. 2C, a ceramic firing container 60 having activated carbon 61 charged inside was prepared, and the object 51 was buried in the activated carbon 61. At this time, the distance between the surface of the activated carbon 61 and the object 51 was about 10 mm.

In addition, the firing container 60, in which the object 51 was buried in the activated carbon 61, was put into the electric furnace 80, and firing was carried out under the conditions of a heating temperature of 760° C. and a heating time of 30 minutes for all examples of the present invention, thereby manufacturing the wire-like and prismatic silver sintered body 10.

Comparative Examples

For Comparative examples 1 and 2, silver clay was manufactured in the same manner as Examples 1 to 7 of the present invention using an alloy powder including the remainder of Ag and Cu of 7.5 mass % (average particle diameter of 33 μm: a microtrack method; atomized powder) as the powder for silver clay.

In addition, for Comparative example 3, silver clay was manufactured in the same manner as Examples 1 to 7 of the present invention using powder for silver clay in which Ag powder (average particle diameter of 5 μm: a microtrack method; atomized powder) and Cu powder (average particle diameter of 20 pin: a microtrack method; reduced powder manufactured by Fukuda Metal Foil & Powder Co., Ltd.) were mixed in a ratio of Ag (the remainder) and Cu of 7.5 mass %.

Furthermore, for Comparative Example 4, silver clay was manufactured in the same manner as Examples 1 to 7 of the present invention using silver powder with a diameter of from 1 μm to 15 μm and a purity of 99.9% as the powder for silver clay.

Additionally, a wire-like object with the dimensions of a diameter of about 1.2 mm and a length of about 50 mm (before firing) and a prismatic object with the dimensions of a length of about 30 mm, a width of about 3 mm and a thickness of about 3 mm (before firing) were manufactured by using the obtained silver clay.

Subsequently, as shown in FIG. 2B, the object 51 of the wire-like object and the prismatic object was fed into an electric furnace (ORTON, manufactured by Evenheat Kiln Inc.) 80 for each example of the present invention at the same time, and dried under the conditions of a drying temperature of 100° C. and a drying time of 60 minutes, thereby removing moisture and the like included in the object 51.

Here, for Comparative Examples 1 and 3, a pre-baking process was carried out in the atmosphere at 500° C. for 30 minutes using the electric furnace 80 so as to remove the binder.

Meanwhile, in Comparative Examples 2 and 4, the pre-baking process was not carried out.

Next, the object 51 for each example of the present invention was subjected to firing at the same time so as to manufacture a silver sintered body.

Specifically, as shown in FIG. 2C, the ceramic firing container 60 having activated carbon 61 charged inside was prepared, and the object 51 was buried in the activated carbon 61. At this time, the distance between the surface of the activated carbon 61 and the object 51 was about 10 mm.

In addition, the firing container 60, in which the object 51 was buried in the activated carbon 61, was put into the electric furnace 80, and firing was carried out under the conditions of a heating temperature of 800° C. and a heating time of 60 minutes for Comparative Examples 1 to 3, and the conditions of a heating temperature of 700° C. and a heating time of 10 minutes for Comparative Example 4, thereby manufacturing the wire-like and prismatic silver sintered body 10.

(Evaluation Method)

An evaluation test was conducted on the manufactured silver clay and silver sintered body in the following manner.

Firstly, regarding the discoloration of the silver clay, a predetermined amount (10 g) of the silver clay was taken and pinched by plates covered with a transparent polyethylene film, and then flattened so as to have a thickness of 3 mm. Additionally, the silver clay was kept at room temperature in the atmosphere, then whether the silver clay was discolored or not was visually observed and evaluated.

As the mechanical properties of the silver sintered body, the flexural strength, tensile strength, density, surface hardness and elongation were measured by the following test methods. Meanwhile, the wire-like sintered body was used for the measurement of tensile strength and elongation, and the prismatic sintered body was used for the measurement of flexural strength, density and surface hardness.

The flexural strength was obtained by measuring a stress trajectory using an AUTOGRAPH AG-X (manufactured by Shimadzu Corporation) with a pushing speed of 0.5 mm/min and measuring the peak stress within the elastic range.

In addition, the tensile strength was, like the above, obtained by measuring a stress trajectory using an AUTOGRAPH AG-X (manufactured by Shimadzu Corporation) with a tension rate of 5 mm/min and measuring the stress at the moment of rupture of the specimen.

Furthermore, the density was measured with an automatic specific gravity measuring apparatus "ARCHIMEDES (driving unit: SA301, data-processing unit: SA601, manufactured by Chou Balance Corp.)."

In addition, the surface hardness was obtained by measuring Vickers hardness under the conditions of a load of 100 g and a load retention time of 10 seconds using an AKASHI microhardness tester after polishing the surface of the specimen.

Furthermore, the elongation was obtained by measuring a stress trajectory using an AUTOGRAPH AG-X (manufactured by Shimadzu Corporation) with a tension rate of 5 mm/min and measuring the elongation at the moment of rupture of the specimen.

Tables 1, 2 and 3 show the manufacturing conditions and evaluation results of Examples 1 to 9, 17 and 18, and Comparative Examples 1 to 4.

TABLE 1

| | | Composition | Discoloration state | Pre-baking | Firing |
|---|---|---|---|---|---|
| Examples of the present invention | 1 | Ag-4 mass % CuO (3 mass % Cu) | No discoloration even after one month has passed. | 500° C. × 30 min | 760° C. × 30 min |
| | 2 | Ag-9.2 mass % CuO (7.5 mass % Cu) | No discoloration even after one month has passed. | 500° C. × 30 min | 760° C. × 30 min |
| | 3 | Ag-12.2 mass % CuO (10 mass % Cu) | No discoloration even after one month has passed. | None | 760° C. × 30 min |
| | 4 | Ag-35 mass % CuO (30 mass % Cu) | No discoloration even after one month has passed. | None | 760° C. × 30 min |
| | 5 | Ag-3 mass % CuO (2 mass % Cu) | No discoloration even after one month has passed. | 500° C. × 30 min | 760° C. × 30 min |
| | 6 | Ag-40 mass % CuO (35 mass % Cu) | No discoloration even after one month has passed. | None | 760° C. × 30 min |
| | 7 | Ag-12.2 mass % CuO (10 mass % Cu) | No discoloration even after one month has passed. | 500° C. × 30 min | 760° C. × 30 min |
| | 8 | Ag-12.2 mass % CuO (10 mass % Cu) | No discoloration even after one month has passed. | None | 760° C. × 30 min |
| | 9 | Ag-9.2 mass % CuO (7.5 mass % Cu) | No discoloration even after one month has passed. | None | 760° C. × 30 min |
| | 17 | Ag-12.2 mass % CuO* (Cu powder was oxidized) | No discoloration even after one month has passed. | None | 760° C. × 30 min |
| | 18 | Ag-12.2 mass % CuO* (Cu powder was oxidized) | No discoloration even after one month has passed. | 500° C. × 30 min | 760° C. × 30 min |
| Comparative examples | 1 | Ag-7.5 mass % Cu (alloy powder) | Discoloration occurs after three days. | 500° C. × 30 min | 800° C. × 60 min |
| | 2 | Ag-7.5 mass % Cu (alloy powder) | Discoloration occurs after three days. | None | 800° C. × 60 min |
| | 3 | Ag-7.5 mass % Cu (mixed powder of Ag powder and Cu powder) | Discoloration occurs after three days. | 500° C. × 30 min | 800° C. × 60 min |
| | 4 | Pure Ag (with a purity of 99.9%) | No discoloration even after one month has passed. | None | 700° C. × 10 min |

*Examples 17 and 18 of the present invention use powder obtained by oxidizing metallic Cu powder instead of CuO powder (heated in an atmosphere at 340° C. × 3 h).

TABLE 2

| | | Composition | Density (g/cm$^3$) | Tensile strength (N/mm$^2$) | Flexural strength (N/mm$^2$) | Elongation (%) | Surface hardness (Hv) |
|---|---|---|---|---|---|---|---|
| Examples of the present invention | 1 | Ag-4 mass % CuO (3 mass % Cu) | 8.16 | 157 | 116 | 15.7 | — |
| | 2 | Ag-9.2 mass % CuO (7.5 mass % Cu) | 8.31 | 164 | 123 | 16.1 | — |
| | 3 | Ag-12.2 mass % CuO (10 mass % Cu) | 9.49 | 211 | 182 | 24.1 | 60.4 |
| | 4 | Ag-35 mass % CuO (30 mass % Cu) | 7.50 | 198 | 138 | 18.5 | — |
| | 5 | Ag-3 mass % CuO (2 mass % Cu) | 8.08 | 156 | 96 | 24.8 | — |
| | 6 | Ag-40 mass % CuO (35 mass % Cu) | 7.52 | 190 | 138 | 16.2 | — |
| | 7 | Ag-12.2 mass % CuO (10 mass % Cu) | 9.51 | 216 | 174 | 23.4 | 70.3 |
| | 8 | Ag-12.2 mass % CuO (10 mass % Cu) | 9.25 | 205 | 175 | 22.5 | 62.0 |
| | 9 | Ag-9.2 mass % CuO (7.5 mass % Cu) | 6.95 | Extremely brittle, therefore testing not possible | | | |
| | 17 | Ag-12.2 mass % CuO* (Cu powder was oxidized) | | Extremely brittle, therefore testing not possible | | | |
| | 18 | Ag-12.2 mass % CuO* (Cu powder was oxidized) | 9.00 | 182 | 136 | 15.3 | 66.4 |
| Comparative examples | 1 | Ag-7.5 mass % Cu (alloy powder) | 8.26 | 161 | 128 | 18.3 | 45.6 |
| | 2 | Ag-7.5 mass % Cu (alloy powder) | | Extremely brittle, therefore testing not possible | | | |
| | 3 | Ag-7.5 mass % Cu (mixed powder of Ag powder and Cu powder) | 8.47 | 160 | 120 | 7.2 | 53.7 |
| | 4 | Pure Ag (with a purity of 99.9%) | 7.58 | 75 | 71 | 15.1 | 32.0 |

*Examples 17 and 18 of the present invention use powder obtained by oxidizing metallic Cu powder instead of CuO powder (heated in an atmosphere at 340° C. × 3 h).

TABLE 3

| | | Composition | Pre-baking | Carbon concen-tration | Oxygen concen-tration |
|---|---|---|---|---|---|
| Examples of the present invention | 3 | Ag-12.2 mass % CuO (10 mass % Cu) | None | 0.002 | 0.011 |
| | 7 | Ag-12.2 mass % CuO (10 mass % Cu) | 500° C. × 30 min | 0.002 | 0.009 |

(Evaluation Results)

As shown in Tables 1 and 2, it was observed that the silver clay of Examples 1 to 9, 17 and 18 of the present invention were not discolored even after being kept at room temperature in an atmosphere for 1 month.

In addition, it became evident that the silver sintered bodies obtained by making and firing the object by using the silver clay of Examples 1 to 8 and 18 of the present invention exhibited higher values in any of the flexural strength, tensile strength, surface hardness and density, which are the indices of mechanical strength, and an equal or higher value even in elongation, compared with those of Comparative example 4, which used pure Ag.

Meanwhile, for Example 9 of the present invention, which included the remainder of Ag and CuO of 9.2 mass %, and were not subjected to a pre-baking process, firing was insufficient, therefore tensile test and the like could not been carried out. Likewise, for Example 17 of the present invention, which used the copper-containing oxide powder obtained by oxidizing metallic copper, and were not subjected to a pre-baking process, firing was insufficient, therefore a tensile test and the like could not been carried out.

In contrast to the above, it was observed that Examples 3, 4, 6 and 8 of the present invention having a amount of CuO of from 12.2 mass % to 40 mass % could obtain silver sintered bodies with a sufficient strength even without a pre-baking process for removing the organic binder. It is assumed that this is because the organic binder is combusted and removed by the oxygen in the CuO powder in the firing process.

Here, the carbon concentration and oxygen concentration of the silver sintered body of Examples 3 and 7 of the present invention was measured. Here, the carbon concentration was measured by an impulse furnace heating—infrared ray absorption method. In addition, the oxygen concentration was measured by a high frequency furnace heating—infrared ray absorption method. The results are shown in Table 3. It is understood that the organic binder is combusted and removed even without a pre-baking process, and that the present invention can be obtained a sufficient strength of the silver sintered body by comparing Examples 3 and 7 of the present invention in Tables 2 and 3.

Furthermore, compared with Examples 1 to 4 and 6 to 8 of the present invention, Example 5 of the present invention having a amount of CuO powder of 3 mass % failed to exhibit an effect of a remarkable improvement in the strength (particularly, flexural strength). In addition, Example 6 of the present invention having a amount of CuO powder of 40 mass % failed to show a beautiful silver color when the fired silver sintered body was polished.

Furthermore, Example 8 of the present invention using a mixture of water-soluble cellulose ester and potato starch as the organic binder also exhibited characteristics and the like similar to those of Examples 3 and 7 of the present invention.

Meanwhile, it was observed that all the silver clay of Comparative examples 1 to 3 was discolored after being kept at room temperature in an atmosphere for 3 days. Here, a tensile test and the like could not be carried out on Comparative example 2, which had not been subjected to a pre-baking process, since the organic binder was not sufficiently removed. It was observed that there was a carbonized phase of the organic binder inside the silver sintered body of Comparative example 2.

In addition, it was observed that Comparative example 4 using pure silver was not discolored, but, compared with Examples 1 to 8 of the present invention, the flexural strength, tensile strength, surface hardness and density, which were the indices of mechanical strength, were liable to be low, therefore being easily deformed.

Example 2

Next, powder for silver clay was obtained by mixing Ag powder (average particle diameter of 5μm: a microtrack method; atomized powder) and CuO powder (average particle diameter of 5 μm: a microtrack method; a reagent manufactured by Kishida Chemical Co., Ltd. with a purity of 97% or more) by a mixing apparatus shown in FIG. 1 in a ratio of Ag (the remainder) and CuO of 12.2 mass %.

In addition, silver powder with a particle diameter of from 1 μm to 15 μm and a purity of 99.9% was prepared as the powder for silver clay.

Subsequently, a binding agent was added and kneaded to each of the above powder for silver clay in the same manner as Examples 1 to 7 of the present invention so as to manufacture silver clay.

The object 51 of Example 10 and Comparative example 5 of the present invention were manufactured as cubic objects with a side length of 10 mm using each of the obtained silver clay. The object 51 from the silver clay including the powder for silver clay including the remainder of Ag and CuO of 12.2 mass % is Example 10 of the present invention, and the object 51 from the silver clay including silver powder with a purity of 99.9% is Comparative example 5.

Additionally, the above cubic object 51 was dried at room temperature for 24 hours and fired so as to manufacture a silver sintered body 10.

Specifically, as shown in FIG. 2C, the ceramic firing container 60 having activated carbon 61 charged inside was prepared, and the object 51 was buried in the activated carbon 61. At this time, the distance between the surface of the activated carbon 61 and the object 51 was about 10 mm.

In addition, the firing container 60, in which the object 51 was buried in the activated carbon 61, was put into the electric furnace 80, and firing was carried out.

Here, for Example 10 of the present invention, the firing was carried out with a firing temperature of 760° C., a heating time of 30 minutes and a rate of temperature rise from room temperature to the firing temperature of 760° C. in a range of from 15° C./min to 80° C./min, specifically 30° C./min.

In addition, for Comparative example 5, the firing was carried out with a firing temperature of 900° C., a heating time of 120 minutes and a rate of temperature rise from room temperature to the firing temperature of 900° C. of 30° C./min.

The density of each of the manufactured silver sintered bodies 10 was evaluated. Evaluation results are shown in Table 4.

TABLE 4

| | Composition | Pre-baking | Firing | Density |
|---|---|---|---|---|
| Examples of the present invention | Ag12.2 mass % CuO (10 mass % Cu) | None | 760° C. × 30 min | 9.3 g/cm$^3$ |
| Comparative example | Pure Ag (with a purity of 99.9%) | None | 900° C. × 120 min | 8.6 g/cm$^3$ |

It is observed that the specimen using the silver clay of Example 10 of the present invention has a high density of 9.3 g/cm$^3$ and is fired far enough into the inside even when the cubic object 51 with a side length of 10 mm is dried and fired with a rate of temperature rise from room temperature to the firing temperature (760° C.) of 30° C./min without a pre-baking process.

On the other hand, the specimen using the silver clay of Comparative example 5 had a density of about 8.6 g/cm$^3$ despite a high firing temperature and a long heating time being set, which showed that firing was insufficient compared with Example 10 of the present invention.

Example 3

Next, powder for silver clay with the compositions shown in Examples 11 to 16 of the present invention in Table 5 was obtained using Ag powder (average particle diameter of 5μm: a microtrack method; atomized powder), CuO powder (average particle diameter of 5 μm: a microtrack method; a reagent manufactured by Kishida Chemical Co., Ltd. with a purity of 97% or more), Cu powder (average particle diameter of 20 μm: a microtrack method; reduced powder manufactured by Fukuda Metal Foil & Powder Co., Ltd.), and $Cu_2O$ powder (average particle diameter of 5 μm: a microtrack method; a reagent manufactured by Kishida Chemical Co., Ltd. with a purity of 90% or more).

In addition, powder for silver clay with the compositions shown in Examples 19 and 20 of the present invention in Table 5 was obtained by mixing copper-containing oxide powder obtained by heating and oxidizing metallic copper powder (average particle diameter of 20 μm: a microtrack method; reduced powder manufactured by Fukuda Metal Foil & Powder Co., Ltd.) in the atmosphere at 340° C. for 3 hours, Ag powder (average particle diameter of 5 μm: a microtrack method; atomized powder) and Cu powder.

Subsequently, a binding agent was added and kneaded to each of the above powder for silver clay in the same manner as Examples 1 to 7 of the present invention so as to manufacture silver clay.

Meanwhile, the amount of CuO and $Cu_2O$ in the silver clay can be measured by conducting an X-ray analysis. Specifically, an X-ray analysis wad conducted using an X-ray diffraction apparatus RINT Ultima (manufactured by Rigaku Corporation) after polishing the silver sintered body obtained by firing the silver clay so as to remove fouling on the surface.

As a result of the analysis, it was observed that the mixture ratio of CuO powder and $Cu_2O$ powder in the powder for silver clay of Examples 11 to 16 of the present invention and the content ratio of CuO powder and $Cu_2O$ powder in the silver clay were identical.

In addition, for Examples 15 and 16 of the present invention, prismatic objects with the dimensions of a length of about 30 mm, a width of about 3 mm and a thickness of about 3 mm (before firing) were manufactured by using the obtained silver clay. Subsequently, as shown in FIG. 2B, each object 51 of the prismatic object was fed into an electric furnace (ORTON, manufactured by Evenheat Kiln Inc.) 80 for each example of the present invention at the same time, and dried under the conditions of a drying temperature of 100° C. and a drying time of 60 minutes, thereby removing moisture and the like included in the object 51.

Here, for Example 16 of the present invention, a pre-baking process was carried out in the atmosphere at 500° C. for 30 minutes using the electric furnace 80 so as to remove the binder. In addition, for Example 15 of the present invention, the pre-baking process was not carried out.

Next, the object 51 was subjected to firing so as to manufacture a silver sintered body.

Specifically, as shown in FIG. 2C, a ceramic firing container 60 having activated carbon 61 charged inside was prepared, and the object 51 was buried in the activated carbon 61. At this time, the distance between the surface of the activated carbon 61 and the object 51 was about 10 mm.

In addition, the firing container 60, in which the object 51 was buried in the activated carbon 61, was put into the electric furnace 80, and firing was carried out under the conditions of a heating temperature of 760° C. and a heating time of 30 minutes, thereby manufacturing a prismatic silver sintered body 10.

(Evaluation Method)

The manufactured silver clay and silver sintered body were subjected to the following evaluation test.

For Examples 11 to 16, 19 and 20 of the present invention, the discoloration of the silver clay was evaluated in the following manner. A predetermined amount (10 g) of the silver clay was taken and pinched by plates covered with a transparent polyethylene film, and then crushed so as to have a thickness of 3 mm. Additionally, the silver clay was kept at room temperature in the atmosphere, then whether the silver clay was discolored or not was visually observed and evaluated.

TABLE 5

| | | Powder composition for silver clay (mass %) | | | | Discoloration state | |
|---|---|---|---|---|---|---|---|
| | | Ag | CuO | $Cu_2O$ | Metallic Cu | After 5 days | After 2 weeks |
| Examples of the present invention | 11 | 85.8 | 12.2 | — | 2 | No discoloration | No discoloration |
| | 12 | 84.8 | 12.2 | — | 3 | No discoloration | Discolored |
| | 13 | 83 | 10 | 5 | 2 | No discoloration | No discoloration |
| | 14 | 82 | 10 | 5 | 3 | No discoloration | Discolored |
| | 15 | 85 | 10 | 5 | — | No discoloration | No discoloration |
| | 16 | 45 | 4 | 51 | — | No discoloration | No discoloration |
| | 19 | 85.8 | 12.2* | — | 2 | No discoloration | No discoloration |
| | 20 | 84.8 | 12.2* | — | 3 | No discoloration | Discolored |

*Examples 19 and 20 of the present invention use powder obtained by oxidizing metallic Cu powder instead of CuO powder (heated in an atmosphere at 340° C. × 3 h).

In addition, for Examples 15 and 16 of the present invention, the density of the silver sintered body was measured with an automatic specific gravity measuring apparatus "ARCHIMEDES (driving unit: SA301, data-processing unit: SA601, manufactured by Chou Balance Corp.)."

The evaluation results are shown in Table 6.

TABLE 6

| | | Powder composition for silver clay (mass %) | | | | | | |
|---|---|---|---|---|---|---|---|---|
| | | Ag | CuO | $Cu_2O$ | Metallic Cu | Pre-baking | Firing | Density |
| Examples of the present invention | 15 | 85 | 10 | 5 | — | None | 760° C. × 30 min | 9.0 |
| | 16 | 45 | 4 | 51 | — | 500° C. × 30 min | 760° C. × 30 min | 7.3 |

(Evaluation Results)

As shown in Table 5, it was observed that the silver clay of Examples 11 to 16, 19 and 20 of the present invention were barely discolored even after being kept at room temperature in an atmosphere for 5 days, and discoloration was suppressed compared with Comparative examples 1 to 3 shown in Table 1.

However, it was observed that Examples 12, 14 and 20 of the present invention having a metallic copper amount of greater than 3 mass % were discolored after 2 weeks. From this fact, it is preferable to set the metallic copper content at 2 mass % or less in order to reliably prevent discoloration of the silver clay.

In addition, as a result of measuring the density of the silver sintered bodies of Examples 15 and 16 of the present invention, it is observed that the density is liable to be lower in Example 16 of the present invention, which has a total amount of CuO powder and $Cu_2O$ powder of more than 55 mass % and has been pre-baked. On the other hand, for Example 15 of the present invention having a total amount of CuO powder and $Cu_2O$ powder of 54 mass % or less, the density becomes relatively high even without being pre-baked.

From the results of the above-described evaluation tests, it is evident that the silver clay using the powder for silver clay according to the present invention can suppress discoloration and obtain a silver sintered body with excellent mechanical strength, elongation and the like.

BRIEF DESCRIPTION OF THE DRAWINGS

1 powder for silver clay (powder for a clayish composition for forming a sintered silver alloy body)
1A Ag powder
1B CuO powder
5 silver clay (clayish composition for forming a sintered silver alloy body)
51 object
10 sintered silver alloy body

The invention claimed is:

1. A composition for forming a sintered silver-copper alloy body consisting of:
a powder constituent consisting of silver powder and copper oxide powder;
a binder; and
water,
wherein, the powder constituent includes copper (II) oxide powder (CuO powder) as the copper oxide powder in a range of from 4 mass % to 35 mass % with respect to the entire powder constituent, and the amount of elemental silver powder is from 46 mass % to 97 mass % with respect to the entire metal elements in the powder constituent.

2. The composition for forming a sintered silver-copper alloy body according to claim 1,
wherein the average particle diameter of the copper oxide powder is from 1 μm to 25 μm.

3. The composition for forming a sintered silver-copper alloy body according to claim 1,
wherein the binder includes at least one kind or two or more kinds of binders selected from the group consisting of a cellulose-based binder, a polyvinyl compound-based binder, an acrylic compound-based binder, a wax-based binder, a resin-based binder, starch, gelatin and flour.

4. A composition for forming a sintered silver-copper alloy body consisting of:
a powder constituent consisting of silver powder and copper oxide powder;
a binder; and
water,
wherein, the powder constituent includes copper (II) oxide powder (CuO powder) and the copper oxide powder includes copper (I) oxide as the copper oxide powder,
the amount of the copper (II) oxide powder (CuO powder) is in a range of from 4 mass % to 35 mass % with respect to the entire powder constituent,
the amount of elemental silver powder is from 46 mass % to 97 mass % with respect to the entire metal elements in the powder constituent, and
the total amount of copper (II) oxide and copper (I) oxide in the powder constituent is 54 mass % or less with respect to the entire powder constituent.

5. Powder for the composition for forming a sintered silver-copper alloy body, consisting of:
silver powder; and
copper oxide powder,
wherein, the powder includes copper (II) oxide powder (CuO powder) as the copper oxide powder in a range of from 4 mass % to 35 mass % with respect to the entire powder, and the amount of elemental silver powder is from 46 mass % to 97 mass % with respect to the entire metal elements in the powder.

6. The powder for the composition for forming a sintered silver-copper alloy body according to claim 5,
wherein the powder includes CuO powder as the copper oxide powder in a range of from 12 mass % to 35 mass % with respect to the entire powder, and the amount of elemental silver powder is from 46 mass % to 90 mass % with respect to the entire metal elements in the powder.

7. The powder for the composition for forming a sintered silver-copper alloy body according to claim 5,
wherein the average particle diameter of the copper oxide powder is from 1 μm to 25 μm.

8. Powder for the composition for forming a sintered silver-copper alloy body, consisting of:
silver powder; and
copper oxide powder,
wherein, the powder constituent includes copper (II) oxide powder (CuO powder) and the copper oxide powder includes copper (I) oxide as the copper oxide powder,
the amount of the powder includes copper (II) oxide powder is in a range of from 4 mass % to 35 mass % with respect to the entire powder,
the amount of elemental silver powder is from 46 mass % to 97 mass % with respect to the entire metal elements in the powder, and
the total amount of copper (II) oxide and copper (I) oxide in the powder is 54 mass % or less with respect to the entire powder.

* * * * *